US005685432A

United States Patent [19]

Maldoff

[11] Patent Number: 5,685,432

[45] Date of Patent: Nov. 11, 1997

[54] HANDLE BAG

[75] Inventor: Gerald Maldoff, Willowdale, Canada

[73] Assignee: Hymopack, Ltd., Toronto, Canada

[21] Appl. No.: 403,123

[22] Filed: Mar. 13, 1995

Related U.S. Application Data

[63] Continuation of Ser. No. 125,241, Sep. 23, 1993, abandoned.

[51] Int. Cl.[6] ..... B65D 33/06; B65D 33/14

[52] U.S. Cl. ..... 206/554; 206/806; 206/813

[58] Field of Search ..... 206/554, 806, 206/813; 383/8, 9, 26, 27; 493/227, 264, 203, 204

[56] References Cited

U.S. PATENT DOCUMENTS

| | | | |
|---|---|---|---|
| Re. 33,264 | 7/1990 | Baxley et al. | 206/554 |
| 4,062,170 | 12/1977 | Orem | 53/390 |
| 4,480,750 | 11/1984 | Dancy | 206/554 |
| 4,493,419 | 1/1985 | Prader et al. | 206/554 |
| 4,560,067 | 12/1985 | Reimann | 206/554 |
| 4,759,639 | 7/1988 | De Matteis | 206/554 X |
| 4,877,473 | 10/1989 | Snowdon et al. | 206/554 |
| 4,981,216 | 1/1991 | Wilfong, Jr. | 206/554 |
| 4,989,732 | 2/1991 | Smith | 248/97 |
| 5,020,750 | 6/1991 | Vrooman et al. | 206/554 |
| 5,183,158 | 2/1993 | Boyd et al. | 156/204 |
| 5,207,328 | 5/1993 | Bose et al. | 383/8 X |
| 5,335,788 | 8/1994 | Beasley et al. | 206/554 |

FOREIGN PATENT DOCUMENTS

| | | |
|---|---|---|
| 2037474 | 9/1991 | Canada . |
| 1299531 | 4/1992 | Canada . |

*Primary Examiner*—Jacob K. Ackun
*Attorney, Agent, or Firm*—Foley & Lardner

[57] ABSTRACT

A T-shirt bag pack having apertures in the lateral handles for suspending the T-shirt bag pack from laterally spaced-apart support rods on a support rack. Each of the handles has an aperture formed by a cold punch leaving a peripheral edge of the aperture securely bonded to an adjacent handle section such that the apertures remain in registry when the bag pack is being handled and the adjacent sections remain retained to adjacent handle sections.

2 Claims, 1 Drawing Sheet

HANDLE BAG

This application is a continuation of application Ser. No. 08/125,241, filed Sep. 23, 1993 and now abandoned.

BACKGROUND OF THE INVENTION

1. Field of the Invention

The present invention relates to plastic film handle bags also known as T-shirt bags, and more particularly, to an improved bag pack suitable for suspending the pack on a dispensing rack.

2. Description of the Prior Art

In recent years, handle bags made of thermo-plastic film material, better known as T-shirt bags, have substantially replaced paper bags as grocery bags and as carry bags for small goods. Such bags are inexpensive, require less storage space, and use up less natural resources than an equivalent paper bag.

However, T-shirt bags are difficult to handle and to dispense. The walls of such bags are so thin and flimsy that an individual bag lacks the structural strength to be set up for loading, as is possible with paper bags.

Dispensing racks have been developed to store and suspend T-shirt bag packs in order to allow the individual bags to be loaded. Examples of such dispensing rack systems for T-shirt bags are shown in U.S. Reissue Patent Re.33,264, reissued Jul. 17, 1990 from U.S. Pat. No. 4,676,378, issued Jun. 30, 1987, Baxley et al.

The system described in the Baxley et al patent requires that the individual bags be held together in a pack, that apertures be formed in the handles, and that the handles be retained together in such a way that the apertures are in registry. When a pack of individual bags is mounted to the rack, the aligned apertures in the handles are penetrated by support rods on the rack. In the case of the Baxley et al patent, flaps are left in the partly formed apertures and these flaps are bonded, when the bags are in a pack, by passing a heated pin through the flaps in a pack. This bonding of the flaps maintains the apertures more or less in registry. When the support rods of the rack pass through the apertures, the flaps are pushed out of the apertures.

In U.S. Pat. No. 4,877,473, Snowdon et al, 1989, the bonding of the handles, in order to keep the apertures in registry, is caused by a hot pin being passed through the handles at a point spaced from the apertures and between the top edge of the handle and the aperture.

SUMMARY OF THE INVENTION

It is an aim of the present invention to provide an improved handle bag pack with a simplified aperture registry means.

It is a further aim of the present invention to provide a simplified handle retaining means.

It is a still further aim of the present invention to provide a simplified method of forming aperture registry and hand retaining means.

A construction in accordance with the present invention comprises a bag pack to be mounted on laterally spaced support rods of a support rack, the bag pack comprising a plurality of identical handle bags with each bag comprising front and rear panels defining an open top and a pair of laterally spaced handles projecting upwardly from the open top of each bag and defining a bag mouth therebetween, each handle comprising a front and rear section integral with the front and rear panels of the bag, aligned mounting apertures defined in each handle section through the bag pack for reception of the handles of the bag pack on the support rods, each aperture defined by an uninterrupted peripheral edge formed in the handle section, handle retaining means including the peripheral edges of the apertures being releasably secured to adjacent peripheral edges in adjacent handle sections for retaining the apertures in registry and for holding the handles of the bags together in the pack.

In a more specific embodiment, the peripheral edges of the apertures are formed by cutting and fixedly secured to adjacent peripheral edges by unheated pressure bonding from the cold cutting knife.

A method of forming, in a pack of individual handle bags stacked in a pack with handles in registry, a series of apertures in registry through each handle while releasably securing the peripheral edges to adjacent edges in adjacent handles, including the step of passing a cold punch through the handles in order to cut out the apertures and pressure bond the peripheral edges to adjacent edges.

Thus, as can be seen, the uninterrupted peripheral edges forming the apertures provide both for the bonding and, therefore, registry of the handles while apertures serve to receive the rods to suspend the bags and, therefore, the pack from the rack.

The fact that the apertures are complete and circular reduces the possibility of a tear being initiated at the aperture. The punched-out plastic sheet material from the aperture can be recycled.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
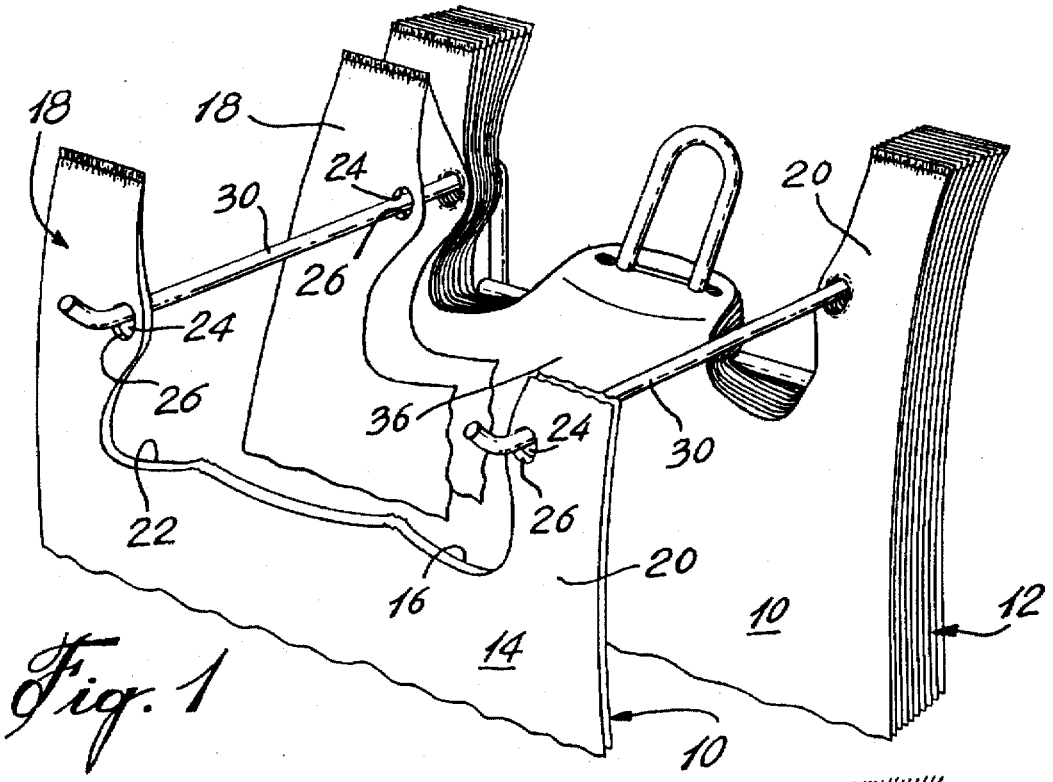
FIG. 1 is a fragmentary perspective view showing a pack of handle bags mounted on a suspension rack in accordance with the present invention.
Figure 2:
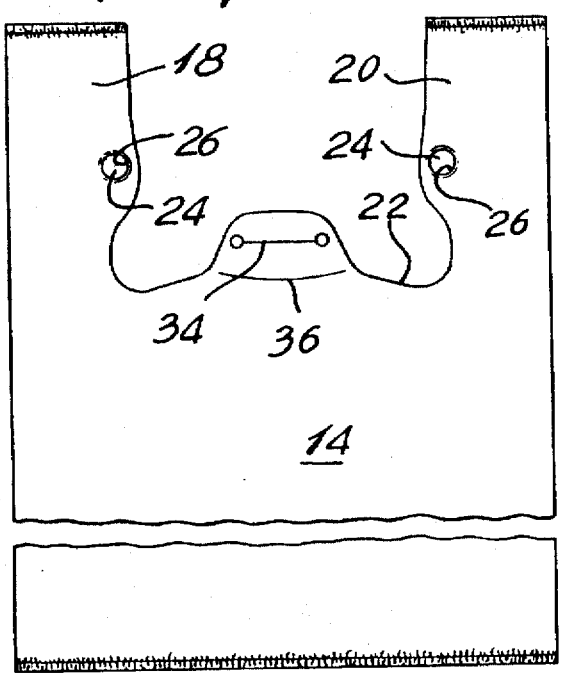
FIG. 2 is a fragmentary front elevation of a single handle bag.

A T-shirt handle bag is shown at 10 and is supplied as a pack 12. The individual T-shirt bags 10 include a front panel 14 and a rear panel 16. A pair of handle loops 18 and 20, which are integral with the front and rear panels 14 and 16 but on either side of a mouth 22, are illustrated as being suspended on a rack 28. The handles 18 and 20 are each provided with circular apertures 24 defined by peripheral uninterrupted edges 26. The apertures 24 are formed, when in a pack 12, by a cold tubular punch passing through the stacked handles. The pressure of the cold punch cutting the circular apertures, fuses or otherwise causes a pressure bond at the peripheral edges 26 between adjacent edges of corresponding panels.

The apertures in each handle have a diameter of approximately ⅝ inch. The aperture is located approximately 3-½ inches from the top of the handle, measured to the center of the aperture. The aperture is spaced at least ¼ inch from the inside edge of the handle forming the mouth of the bag.

As seen, no flaps are left in the apertures in the handles, but the material is completely removed by the cold punch.

The fusing or pressure bonding of the peripheral edges 26 is such as to retain the handles 18 and 20 so that the apertures 24 are in registry when it is necessary to suspend a pack 12 onto a rack 28 provided with suspension rods 30.

Figure 3:
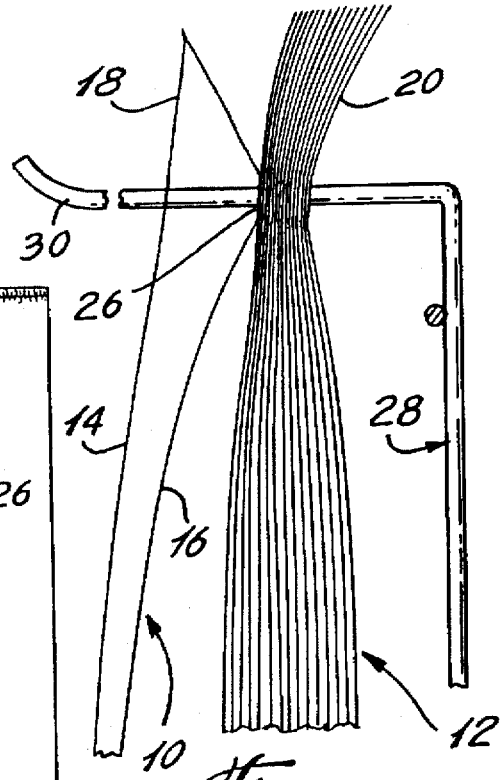
FIG. 3 is a fragmentary side elevation of the pack of handle bags shown in FIG. 1.

The suspension rods 30 pass through the apertures 24, as shown in FIGS. 1 and 3, while the hook 32 passes through the slit 34 in the body of the T-shirt bag 10. A slit 36 is provided below the slit 34 to allow the bag to be torn therefrom at the mouth 22.

The aperture 24 and the cold pressure bonding of the edges of the aperture are formed in one operation, thereby simplifying the provision of the necessary features of having an aperture for suspending the handles and at the same time having retention and registry means to hold the handles together so that the apertures are in registry.

It is well known that these bags are so flimsy that even though the panels of the bag might be bonded together in the proximity of slit 34, that if the handles are not somehow retained or bonded together, but in a manner to be easily released, the handles will flop all over, and the resulting pack will be in complete disarray.

I claim:

1. A handle bag dispensing system comprising a bag pack in combination with a support rack, the support rack including a pair of laterally spaced-apart support rods, the bag pack comprising a plurality of identical handle bags with each bag comprising front and rear panels defining an open top and a pair of laterally spaced handles projecting upwardly from the open top of each bag and defining a bag mouth therebetween, each handle comprising a top edge, a front and rear section integral with the front and rear panels of the bag, aligned mounting apertures defined in each handle section through the bag pack receiving the handle sections of the bag pack on the support rods, each aperture being in the form of a circular opening having a diameter greater than the respective support rod and defined by an endless, uninterrupted, annular peripheral edge formed in each front and rear handle section of each handle, the peripheral edge of each aperture being releasably secured to an adjacent peripheral edge of an adjacent front and rear handle section, the edges forming the apertures being releasable upon pulling away of a handle section from an adjacent handle section, the aperture of each section being spaced intermediate the handle top edge and the open top of the bag, and being located within the confines of the handle but near the bag mouth, the aperture further remaining within the confines of the handle even upon pulling away of the handle section, whereby the apertures in the bag pack are retained in registry and the handles of the bag are held together in the bag pack and wherein the peripheral edges of the apertures are cold pressure bonded, thus maintaining the apertures in registry.

2. The handle bag dispensing system as defined in claim 1, wherein the aperture has a diameter of approximately ⅝ inch and is located approximately 3-½ inches from the top edge of the handle measured to the center of the aperture while the aperture is spaced ¼ inch from the inside edge of the handle forming the mouth of the bag and measured to the edge of the aperture.

* * * * *